US009597864B2

(12) United States Patent
Kersten et al.

(10) Patent No.: US 9,597,864 B2
(45) Date of Patent: Mar. 21, 2017

(54) INTAGLIO PRINTING PRESS

(71) Applicant: KBA-NOTASYS SA, Lausanne (CH)

(72) Inventors: Thomas Kersten, Lausanne (CH); Johannes Georg Schaede, Würzburg (DE); Alain Würsch, La Tour-de-Peliz (CH); Volkmar Rolf Schwitzky, Würzburg (DE); Volker Scharkus, Würzburg (DE)

(73) Assignee: KBA-NotaSys SA, Lausanne (CH)

( * ) Notice: Subject to any disclaimer, the term of this patent is extended or adjusted under 35 U.S.C. 154(b) by 0 days.

(21) Appl. No.: 14/396,673

(22) PCT Filed: Apr. 24, 2013

(86) PCT No.: PCT/IB2013/053251
§ 371 (c)(1),
(2) Date: Oct. 23, 2014

(87) PCT Pub. No.: WO2013/160856
PCT Pub. Date: Oct. 31, 2013

(65) Prior Publication Data

US 2015/0047520 A1 Feb. 19, 2015

(30) Foreign Application Priority Data

Apr. 24, 2012 (EP) ..... 12165388

(51) Int. Cl.
*B41F 9/08* (2006.01)
*B41F 9/00* (2006.01)
(Continued)

(52) U.S. Cl.
CPC ..... *B41F 9/003* (2013.01); *B41F 9/00* (2013.01); *B41F 9/01* (2013.01); *B41F 9/061* (2013.01);
(Continued)

(58) Field of Classification Search
CPC ..... B41F 9/08; B41F 9/10; B41F 9/06; B41F 3/38; B41F 13/004
See application file for complete search history.

(56) References Cited

U.S. PATENT DOCUMENTS 3,604,350 A * 9/1971 Rosenstadt ..... 101/181
4,409,896 A * 10/1983 Hamisch, Jr. ..... 101/367
(Continued)

FOREIGN PATENT DOCUMENTS

EP 00633134 6/1994
EP 0 653 302 5/1995
(Continued)

OTHER PUBLICATIONS

International Search Report for PCT/IB2013/053251, mailed Nov. 15, 2013, 4 pages.
(Continued)

*Primary Examiner* — David Banh
(74) *Attorney, Agent, or Firm* — Nixon & Vanderhye P.C.

(57) ABSTRACT

There is described an intaglio printing press (1; 1*) comprising an intaglio cylinder (8) and an ink wiping system (10) with a rotating wiping roller assembly (11) contacting a circumference of the intaglio cylinder (8) for wiping excess ink from the surface of the intaglio cylinder (8), a rotational speed of the wiping cylinder being adjustable with respect to a rotational speed of the intaglio cylinder (8). The intaglio printing press (1; 1*) comprises an adjustable drive unit (25), which adjustable drive unit (25) is interposed between the wiping roller assembly (11) acting as a rotating output body of the adjustable drive unit (25) and a driving gear (100) coupled to the intaglio cylinder (8) and acting as a rotating input body of the adjustable drive unit (25). The adjustable drive unit (25) is designed to allow selected adjustment of a rotational speed of the wiping roller assembly (11) with respect to a rotational speed of the driving gear
(Continued)

(100). In an adjusting state of the adjustable drive unit (25), driving into rotation of the wiping roller assembly (11) is adjusted by means of an adjustment motor (700) of the adjustable drive unit (25). In a non-adjusting state of the adjustable drive unit (25), the adjustment motor (700) is inoperative and driving into rotation of the wiping roller assembly (11) is performed exclusively mechanically via the adjustable drive unit (25), the wiping roller assembly (11) rotating at a defined rotational speed with respect to the rotational speed of the intaglio cylinder (8).

19 Claims, 7 Drawing Sheets

(51) Int. Cl.

| | |
|---|---|
| ***B41F 13/00*** | (2006.01) |
| ***B41F 13/008*** | (2006.01) |
| ***B41F 9/01*** | (2006.01) |
| ***B41F 9/10*** | (2006.01) |
| ***B41F 9/06*** | (2006.01) |

(52) U.S. Cl.

CPC ..... *B41F 9/08* (2013.01); *B41F 9/10* (2013.01); *B41F 13/008* (2013.01); *B41F 13/0008* (2013.01); *B41P 2213/208* (2013.01)

(56) References Cited

U.S. PATENT DOCUMENTS

| | | | | |
|---|---|---|---|---|
| 4,892,035 | A * | 1/1990 | Terzuolo | 101/148 |
| 5,950,502 | A | 9/1999 | Genovese | |
| 6,014,907 | A * | 1/2000 | Rilbe | 74/395 |
| 6,050,187 | A * | 4/2000 | Kuhn et al. | 101/155 |
| 6,111,261 | A | 8/2000 | Bolza-Schunemann et al. | |
| 6,176,482 | B1 | 1/2001 | Reinhard et al. | |
| 6,308,622 | B1 * | 10/2001 | Steffen et al. | 101/248 |
| 7,011,020 | B2 | 3/2006 | Dunninger et al. | |
| 8,231,125 | B2 | 7/2012 | Hendle et al. | |
| 8,516,960 | B2 | 8/2013 | Bollettin et al. | |
| 2004/0237816 | A1 | 12/2004 | Dunninger et al. | |
| 2005/0016399 | A1 * | 1/2005 | Holm et al. | 101/352.06 |
| 2005/0039617 | A1 * | 2/2005 | Kusaka et al. | 101/216 |
| 2005/0127595 | A1 | 6/2005 | Hendle et al. | |
| 2006/0144265 | A1 | 7/2006 | Dunninger et al. | |
| 2009/0096156 | A1 | 4/2009 | Hendle et al. | |
| 2009/0183644 | A1 | 7/2009 | Bollettin et al. | |
| 2010/0147168 | A1 * | 6/2010 | Puschel et al. | 101/217 |
| 2012/0046142 | A1 * | 2/2012 | Miyawaki et al. | 475/331 |
| 2012/0312180 | A1 | 12/2012 | Scheade et al. | |
| 2012/0328179 | A1 | 12/2012 | Glock et al. | |
| 2013/0112095 | A1 | 5/2013 | Schaede et al. | |
| 2013/0312625 | A1 * | 11/2013 | Kamoda | 101/153 |
| 2014/0218502 | A1 | 8/2014 | Schaede et al. | |

FOREIGN PATENT DOCUMENTS

| | | |
|---|---|---|
| EP | 0881072 | 12/1998 |
| EP | 0 984 201 | 3/2000 |
| EP | 1 717 025 | 11/2006 |
| WO | WO 97/36813 | 10/1997 |
| WO | WO 97/37329 | 10/1997 |
| WO | WO 03/047862 | 6/2003 |
| WO | WO 03/070465 | 8/2003 |
| WO | WO 2007/116353 | 10/2007 |
| WO | WO 2011/077348 | 6/2011 |
| WO | WO 2011/077350 | 6/2011 |
| WO | WO 2011/077351 | 6/2011 |
| WO | WO 2011/161656 | 12/2011 |

OTHER PUBLICATIONS

Written Opinion for PCT/IB2013/053251, mailed Nov. 15, 2013, 5 pages.

* cited by examiner

INTAGLIO PRINTING PRESS

This application is the U.S. national phase of International Application No. PCT/IB2013/053251, filed 24 Apr. 2013, which designated the U.S. and claims priority to EP Application No. 12165388.5, filed 24 Apr. 2012, the entire contents of each of which are hereby incorporated by reference.

TECHNICAL FIELD

The present invention generally relates to an intaglio printing press of the type comprising an intaglio cylinder and an ink wiping system with a rotating wiping roller assembly contacting a circumference of the intaglio cylinder for wiping excess ink from the surface of the intaglio cylinder, a rotational speed of the wiping cylinder being adjustable with respect to a rotational speed of the intaglio cylinder.

BACKGROUND OF THE INVENTION

European Patent Publication No. EP 0 633 134 A1 discloses an intaglio printing press comprising a wiping cylinder whose rotational speed is controlled and adjusted with respect to a rotational speed of a plate cylinder by way of corresponding independent motors.

A problem with the above solution resides in the fact that, in case of failure of an independent drive, the associated system and function become inoperative and cannot be exploited further unless the defective drive is replaced by a new drive, which process is typically time-consuming and involves substantial downtimes which negatively affect productivity.

An improved and more robust approach is therefore required.

SUMMARY OF THE INVENTION

A general aim of the invention is therefore to provide an intaglio printing press of the above-mentioned-type comprising means to adjust a rotational speed of the wiping roller assembly, which solution is more robust than the solutions known in the art.

A further aim of the invention is to provide such a solution which is as compact as possible in order to facilitate the integration thereof in the intaglio printing press.

Still another aim of the invention is to provide such a solution which can be efficiently used to adjust a rotational speed of a wiping cylinder with respect to an intaglio cylinder of an intaglio printing press.

These aims are achieved thanks to the adjustable drive unit defined in the claims.

There is accordingly provided an intaglio printing press comprising an intaglio cylinder and an ink wiping system with a rotating wiping roller assembly contacting a circumference of the intaglio cylinder for wiping excess ink from the surface of the intaglio cylinder, a rotational speed of the wiping cylinder being adjustable with respect to a rotational speed of the intaglio cylinder, wherein the intaglio printing press comprises an adjustable drive unit, which adjustable drive unit is interposed between the wiping roller assembly acting as a rotating output body of the adjustable drive unit and a driving gear coupled to the intaglio cylinder and acting as a rotating input body of the adjustable drive unit. The adjustable drive unit is designed to allow selected adjustment of a rotational speed of the wiping roller assembly with respect to a rotational speed of the driving gear. In an adjusting state of the adjustable drive unit, driving into rotation of the wiping roller assembly is adjusted by means of an adjustment motor of the adjustable drive unit to change the rotational speed of the wiping roller assembly with respect to the rotational speed of the intaglio cylinder. In a non-adjusting state of the adjustable drive unit, the adjustment motor is inoperative and driving into rotation of the wiping roller assembly is performed exclusively mechanically via the adjustable drive unit, the wiping roller assembly rotating at a defined rotational speed with respect to the rotational speed of the intaglio cylinder.

In accordance with the invention, it shall therefore be appreciated that the adjustment motor is only operative in the adjusting state of the adjustable drive unit, i.e. the adjustment motor is only used for the purpose of adjusting a rotational speed of the wiping roller assembly with respect to the rotational speed of the intaglio cylinder. In the non-adjusting state, the adjustment motor is totally inoperative and the wiping roller assembly is driven into rotation exclusively mechanically via the adjustable drive unit. In other words, any failure of the adjustment motor will not have any impact on the normal operation of the intaglio printing press. In addition, since the adjustment motor is only operative in the adjusting state of the adjustable drive unit, usage of the adjustment motor is reduced, leading to an extended usability.

In accordance with a preferred embodiment of the invention, the adjustable drive unit comprises an adjustable mechanical transmission unit having a drive input coupled to and rotating together with the driving gear, a drive output coupled to and rotating together with the wiping roller assembly, and a control input coupled to and driven into rotation by the adjustment motor.

In accordance with a preferred embodiment of the invention, the adjustable mechanical transmission unit is designed as a planetary gear unit comprising a ring gear acting as the drive input of the planetary gear unit, a star gear disposed centrally with respect to the ring gear and acting as the control input of the planetary gear unit, and a plurality of planet gears interposed between and meshing with the ring gear and the star gear, which plurality of planet gears are carried by a planet carrier coaxial with the ring gear and star gear and acting as the drive output of the planetary gear unit.

Advantageously, the rotational speed of the wiping roller assembly is adjustable, in the adjusting state of the adjustable drive unit, within a range of +20% and −20% with respect to a nominal rotational speed of the wiping roller assembly in the non-adjusting state of the adjustable drive unit.

In a preferred variant, the intaglio printing press further comprises a retractable coupling mechanism coupled between a drive output of the adjustable drive unit and a driving head part of the wiping roller assembly, which retractable coupling mechanism is operable to release the driving head part of the wiping roller assembly during a maintenance operation.

In a further variant, the wiping roller assembly is coupled to an output of the adjustable drive unit via a spherical bearing.

Also claimed is an adjustment system designed to allow adjustment of the rotational speed of a wiping roller assembly of the aforementioned intaglio printing press.

Further advantageous embodiments of the adjustable drive unit and of the printing press form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of the application to an intaglio printing press as used for the production of banknotes and like security documents.

Figure 1:
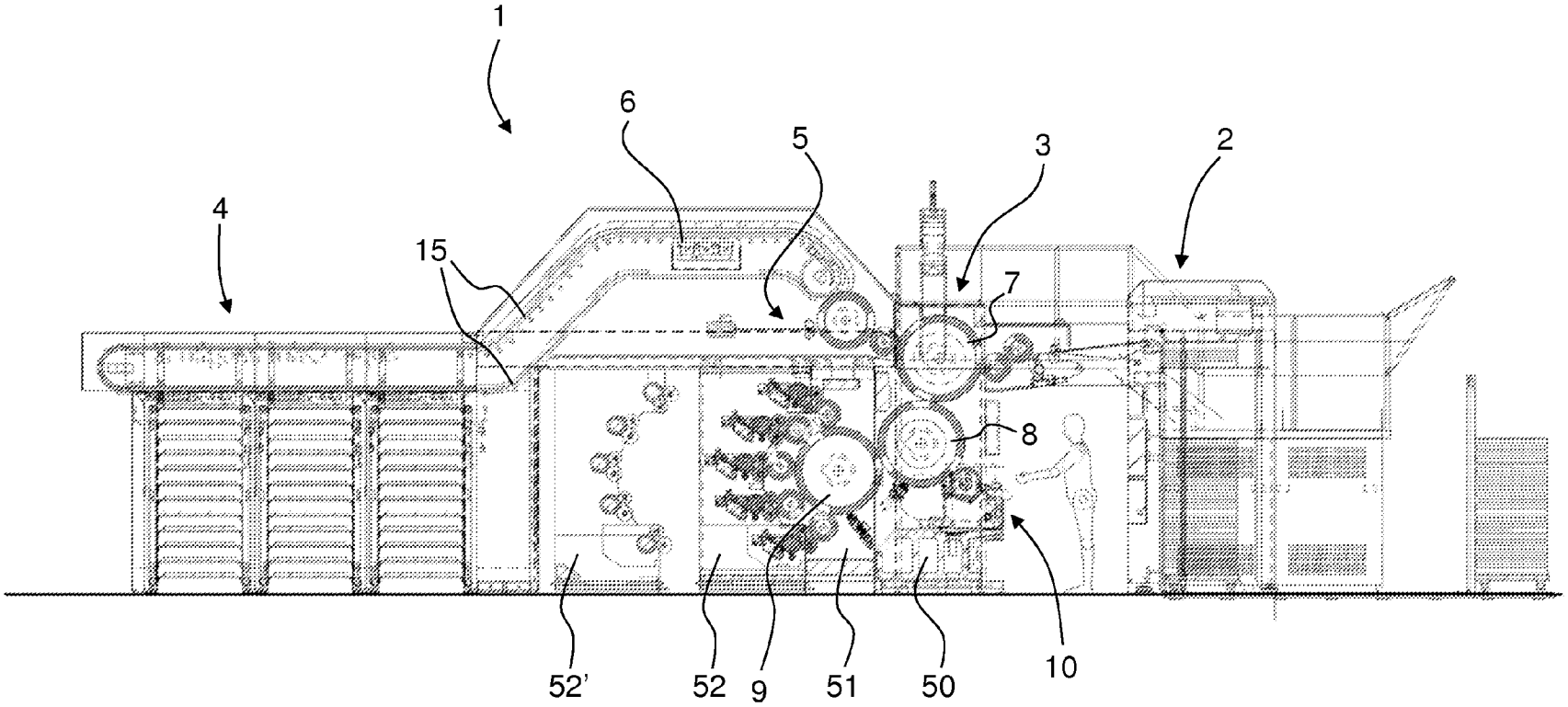
FIG. 1 is a side-view of an intaglio printing press according to a first embodiment of the invention.
Figure 2:
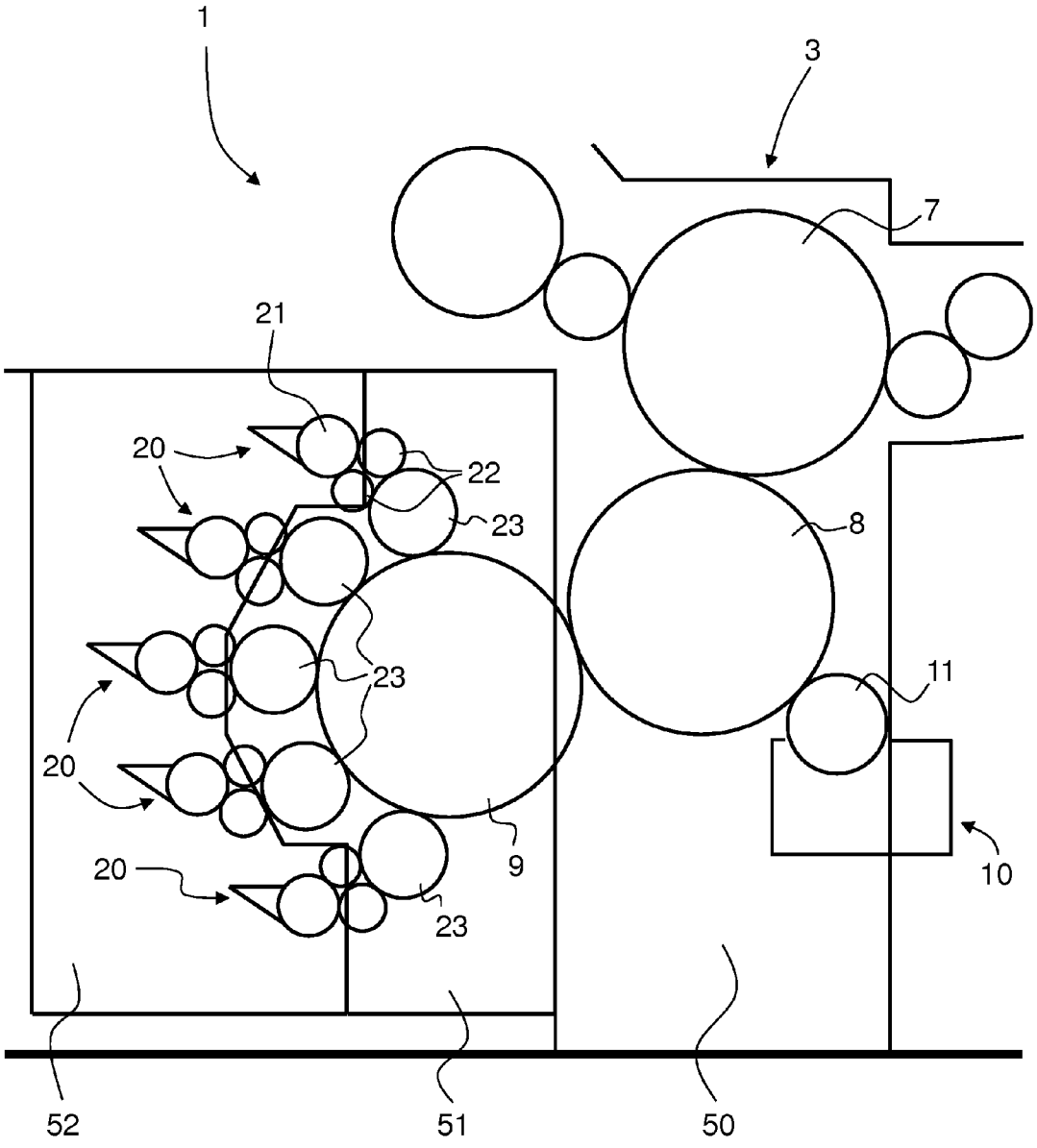
FIG. 2 is an enlarged schematic side view of the printing unit of the intaglio printing press of FIG. 1.
Figure 3:
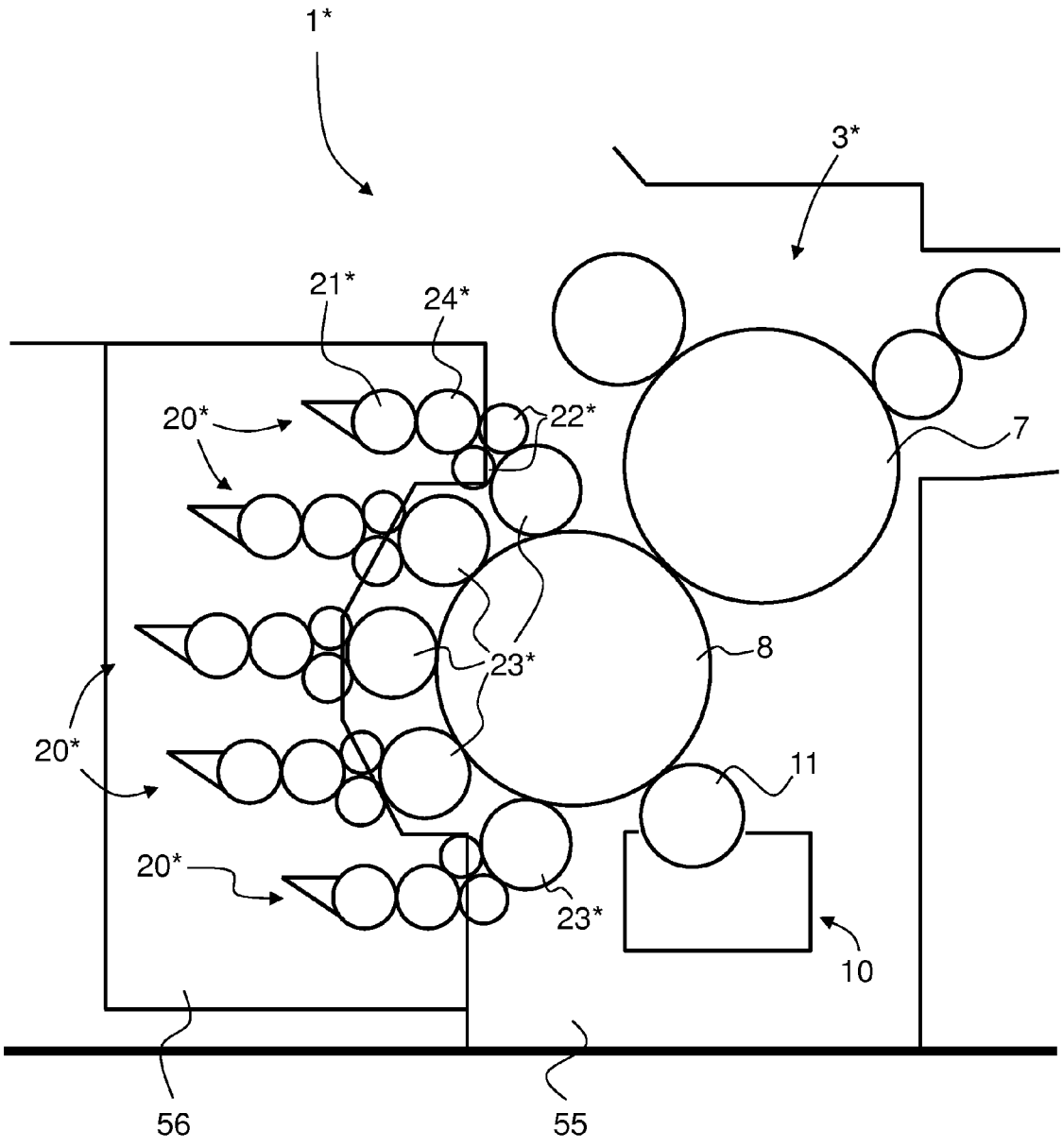
FIG. 3 is a schematic partial side view of an intaglio printing press according to a second embodiment of the invention.

Within the context of the present invention, the expression "intaglio cylinder", when used, designates either a cylinder whose surface is provided with intaglio patterns engraved directly onto the circumference of the cylinder or of a cylinder sleeve, or a plate cylinder carrying on its circumference at least one intaglio printing plate with engraved intaglio patterns (the second solution being now more common in the art). In the following description, it will be assumed for the sake of illustration that the intaglio cylinder is a plate cylinder carrying several intaglio printing plates on its circumference. In this context, the expression "chablon cylinder" (which is equivalent to the expression "colour-selector cylinder" also used in the art) is to be understood as designating a cylinder with raised portions whose purpose is to selectively transfer ink patterns to the circumference of the plate cylinder, whether indirectly (as shown in FIGS. 1 and 2) or directly (as shown in FIG. 3). Furthermore, the expression "ink-collecting cylinder" (which is in particular relevant to the embodiment of FIGS. 1 and 2) designates within the context of the present invention a cylinder whose purpose is to collect inks from multiple chablon cylinders (which have been inked by associated inking devices) before transferring the resulting multicolour pattern of inks onto the plate cylinder. In the art of intaglio printing, the expression "Orlof cylinder" is also typically used as an equivalent to the expression "ink-collecting cylinder".

FIGS. 1 and 2 schematically illustrate an intaglio printing press according to a first embodiment of the invention, which printing press is generally designated by reference numeral 1.

More precisely, FIG. 1 shows a sheet-fed intaglio printing press 1 comprising a sheet feeder 2 for feeding sheets to be printed, an intaglio printing unit 3 for printing the sheets, and a sheet delivery unit 4 for collecting the freshly-printed sheets. The intaglio printing unit 3 includes an impression cylinder 7, a plate cylinder 8 (in this example, the plate cylinder 8 is a three-segment plate cylinder carrying three intaglio printing plates), an inking system comprising an ink-collecting cylinder, or Orlof cylinder, 9 (here a three-segment blanket cylinder carrying a corresponding number of blankets) for inking the surface of the intaglio printing plates carried by the plate cylinder 8 and an ink wiping system 10 for wiping the inked surface of the intaglio printing plates carried by the plate cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the plate cylinder 8 where intaglio printing is performed. Once printed, the sheets are transferred away from the impression cylinder 7 for conveyance by a sheet transporting system 15 in order to be delivered to the delivery unit 4. The sheet transporting system 15 conventionally comprises a sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession to a corresponding one of the gripper bars.

During their transport to the sheet delivery unit 4, the freshly printed sheets are preferably inspected by an optical inspection system 5. In the illustrated example, the optical inspection system 5 is advantageously an inspection system as disclosed in International Publication No. WO 2011/161656 A1 (which publication is incorporated herein by reference in its entirety), which inspection system 5 comprises a transfer mechanism and an inspection drum located at the transfer section between the impression cylinder 7 and chain wheels of the sheet transporting system 15. The optical inspection system 5 could alternatively be an inspection system placed along the path of the sheet transporting system 15 as described in International Publications Nos. WO 97/36813 A1, WO 97/37329 A1, and WO 03/070465 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 15. Drying or curing could possibly be performed prior to the optical inspection of the sheets.

FIG. 2 is a schematic view of the intaglio printing unit 3 of the intaglio printing press 1 of FIG. 1. As already mentioned, the printing unit 3 basically includes the impression cylinder 7, the plate cylinder 8 with its intaglio printing plates, the inking system with its ink-collecting cylinder 9, and the ink wiping system 10.

The inking system comprises in this example five inking devices 20, all of which cooperate with the ink-collecting cylinder 9 that contacts the plate cylinder 8. It will be understood that the illustrated inking system is adapted for indirect inking of the plate cylinder 8, i.e. inking of the intaglio printing plates via the ink-collecting cylinder 9. The inking devices 20 each include an ink duct 21 cooperating in this example with a pair of ink-application rollers 22. Each pair of ink-application rollers 22 in turn inks a corresponding chablon cylinder 23 which is in contact with the ink-collecting cylinder 9. As is usual in the art, the surface of the chablon cylinders 23 is structured so as to exhibit raised portions corresponding to the areas of the intaglio printing plates intended to receive the inks in the corresponding colours supplied by the respective inking devices 20.

As shown in FIGS. 1 and 2, the impression cylinder 7 and plate cylinder 8 are both supported by a stationary (main) frame 50 of the printing press 1. The inking devices 20 (including the ink duct 21 and ink-application rollers 22) are supported in a mobile inking carriage 52, while the ink-collecting cylinder 9 and chablon cylinders 23 are supported in an intermediate carriage 51 located between the inking carriage 52 and the stationary frame 50. Both the inking carriage 52 and the intermediate carriage 51 are advantageously suspended under supporting rails. In FIG. 1, reference numeral 52' designates the inking carriage 52 in a retracted position.

The twin-carriage configuration of the intaglio printing press 1 illustrated in FIGS. 1 and 2 corresponds in essence to the configuration disclosed in International Publications Nos. WO 03/047862 A1, WO 2011/077348 A1, WO 2011/077350 A1 and WO 2011/077351 A1, all assigned to the present Applicant and which are incorporated herein by reference in their entirety.

The ink wiping system 10, on the other hand, typically comprises a wiping tank, a wiping roller assembly 11 supported on and partly located in the wiping tank and contacting the plate cylinder 8, cleaning means for removing wiped ink residues from the surface of the wiping roller assembly 11 using a wiping solution that is sprayed or otherwise applied onto the surface of the wiping roller assembly 11, and a drying blade contacting the surface of the wiping roller assembly 11 for removing wiping solution residues from the surface of the wiping roller assembly 11. A particularly suitable solution for the ink wiping system 10 is disclosed in International Publication No. WO 2007/116353 A1 which is incorporated herein by reference in its entirety.

FIG. 3 is a schematic partial side view of an intaglio printing press according to a second embodiment of the invention, which intaglio printing press is designated by reference numeral 1*, for the sake of distinction.

In contrast to the first embodiment shown in FIGS. 1 and 2, the intaglio printing press 1* of FIG. 3 comprises a printing unit 3* with a direct inking system (i.e. without any ink-collecting cylinder), the chablon cylinders, designated by reference numerals 23*, cooperating directly with the plate cylinder 8.

The inking devices, designated by reference numerals 20*, each include, in this example, an ink duct 21*, an ink-transfer roller 24*, and a pair of ink-application rollers 22* adapted to cooperate with the associated chablon cylinder 23*. The inking devices 20* are supported on an inking carriage 56 that is adapted to move between a working position (shown in FIG. 3) and a retracted position (not shown) in a way similar to the inking carriage 52 of FIGS. 1 and 2. The impression cylinder 7, plate cylinder 8, chablon cylinders 23* and ink wiping system 10 are all supported in a stationary frame 55 of the intaglio printing press 1*.

Both the intaglio printing press 1 of FIGS. 1 and 2 and the intaglio printing press 1* of FIG. 3 may be provided with an adjustable drive unit in accordance with the invention.

According to the invention which will be described in reference to a preferred embodiment thereof which is illustrated by FIGS. 4 to 7, such an adjustable drive unit is interposed between the wiping roller assembly 11 (which wiping roller assembly 11 acts as a rotating output body of the adjustable drive unit) and a driving gear, designated by reference numeral 100 in FIGS. 4 to 7 (which driving gear 100 acts as a rotating input body of the adjustable drive unit).

In accordance with the invention, the adjustable drive unit is designed to allow selected adjustment of a rotational speed of the wiping roller assembly 11 with respect to a rotational speed of the intaglio cylinder 8. More precisely, in accordance with the invention, in an adjusting state of the adjustable drive unit, driving into rotation of the wiping roller assembly 11 is adjusted by means of an adjustment motor of the adjustable drive unit. In a non-adjusting state of the adjustable drive unit, the adjustment motor is inoperative and the driving into rotation of the wiping roller assembly 11 is performed exclusively mechanically via the adjustable drive unit, the wiping roller assembly 11 rotating at a defined rotational speed with respect to the rotational speed of the intaglio cylinder 8.

More specifically, referring to the preferred embodiment of FIGS. 4 to 7, a purpose of the adjustable drive unit is to form part of an adjustment system designed to allow for an adjustment of the rotational speed of the wiping roller assembly 11 with respect to the rotational speed of the intaglio cylinder 8. Preferably, the adjustable drive unit is designed to allow adjustment of the rotational speed of the wiping roller assembly 11, in the adjusting state of the adjustable drive unit, within a range of +20% and −20% with respect to a nominal rotational speed of the wiping roller assembly 11 in the non-adjusting state of the adjustable drive unit.

Figure 4:
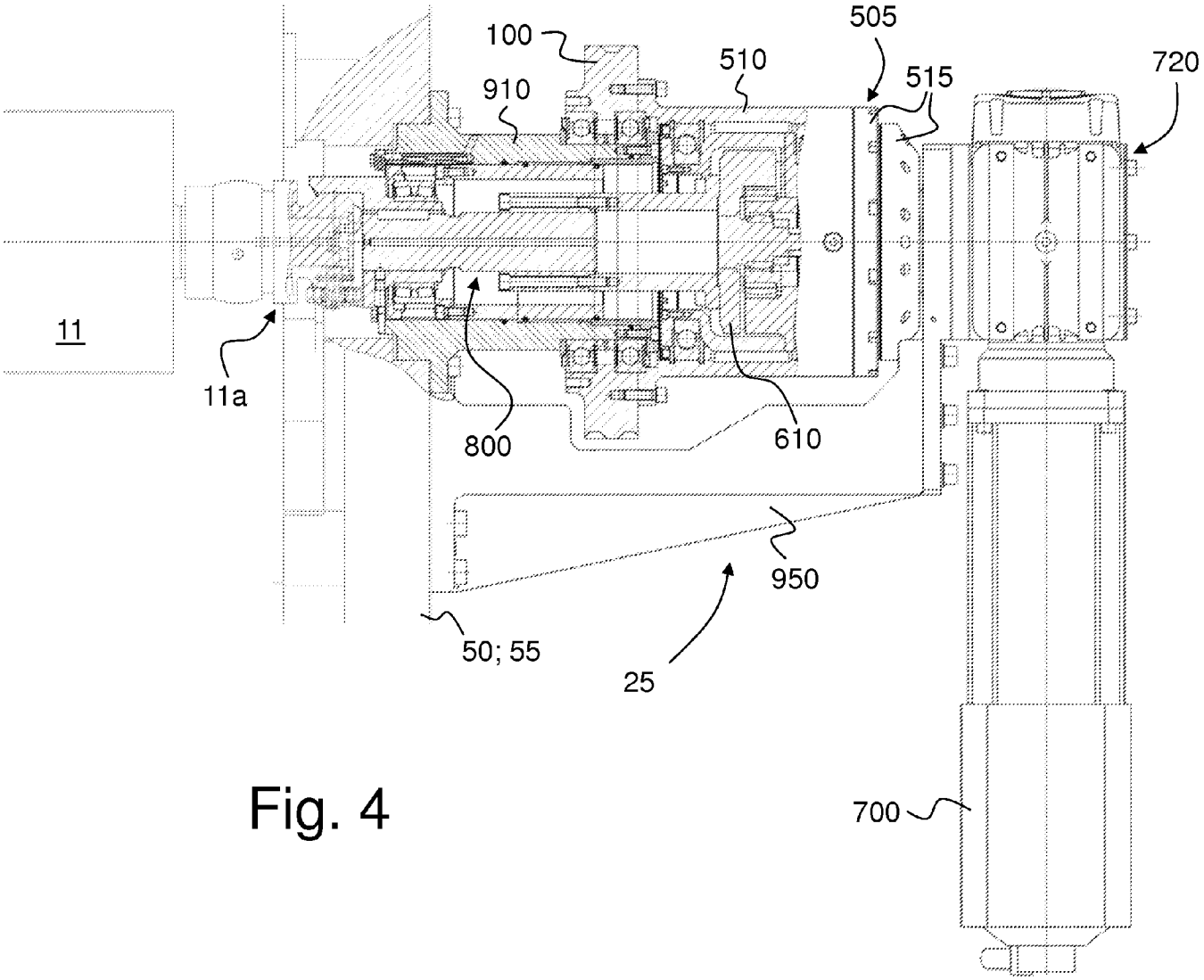
FIG. 4 is a schematic partial side view of an adjustable drive unit for driving and adjusting rotation of a wiping roller assembly of an ink wiping system of the intaglio printing press of FIGS. 1 and 2 or of FIG. 3 in accordance with a preferred embodiment of the invention.

FIG. 4 is a schematic partial side view of an adjustable drive unit, designated by reference numeral 25, which is interposed between the wiping roller assembly 11 (acting as the rotating output body) and a driving gear 100 coupled to the intaglio cylinder 8 (acting as the rotating input body). In this example, the adjustable drive unit 25 comprises the driving gear 100, an adjustable mechanical transmission unit, identified by reference numeral 505, interposed between the driving gear 100 and the wiping roller assembly 11, and an adjustment motor 700.

In accordance with this preferred embodiment, the adjustable mechanical transmission unit is advantageously designed as a planetary gear unit 505 having a drive input coupled to and rotating together with the driving gear 100, a drive output coupled to and rotating together with the wiping roller assembly 11, and a control input coupled to and driven into rotation (when in an adjusting state) by the adjustment motor 700.

In a non-adjusting state of the adjustable drive unit 25, the adjustment motor 700 is inoperative and driving into rotation of the wiping roller assembly 11 is performed exclusively mechanically via the adjustable drive unit 25 (i.e. via the planetary gear unit 505), the wiping roller assembly 11 rotating at a nominal rotational speed defined by the rotational speed of the driving gear 100.

FIG. 4 shows that the adjustment motor 700 is supported and secured by means of a (first) support member 950 onto the same machine frame as the wiping roller assembly 11, namely the stationary machine frame 50 in FIG. 1, 2 or 55 in FIG. 3. A further (second) support member 910 is provided in order to support and secure one end of the adjustable mechanical transmission unit 505 onto the relevant machine frame (50 in FIG. 1, 2 or 55 in FIG. 3), the adjustable mechanical transmission unit 505 being held (via a suitable bearing arrangement) at the other end (i.e. on the side of the drive input of the planetary gear unit) by the (first) support member 950.

FIG. 4 also shows an outer casing 510 and lateral member 515 of the planetary gear unit 505, both elements 510, 515 being secured to one another and to the driving gear 100.

On a drive output side, the planetary gear unit 505 is coupled to a driving head part 11*a* of the wiping roller assembly 11 via an output member 610. Preferably, such coupling is performed, as illustrated, via a retractable coupling mechanism 800 coupled between a drive output (i.e. output member 610) of the adjustable drive unit 25 and the driving head part 11*a* of the wiping roller assembly 11, which retractable coupling mechanism 800 is operable to release the driving head part 11*a* of the wiping roller assembly 11 during a maintenance operation as this will be explained in reference to FIG. 5.

In the illustrated example, the adjustment motor 700 is coupled to the control input of the planetary gear unit 505 via a worm drive 720, thereby allowing the adjustment motor 700 to be supported at a right angle with respect to the axis of rotation of the planetary gear unit 505.

Figure 5:
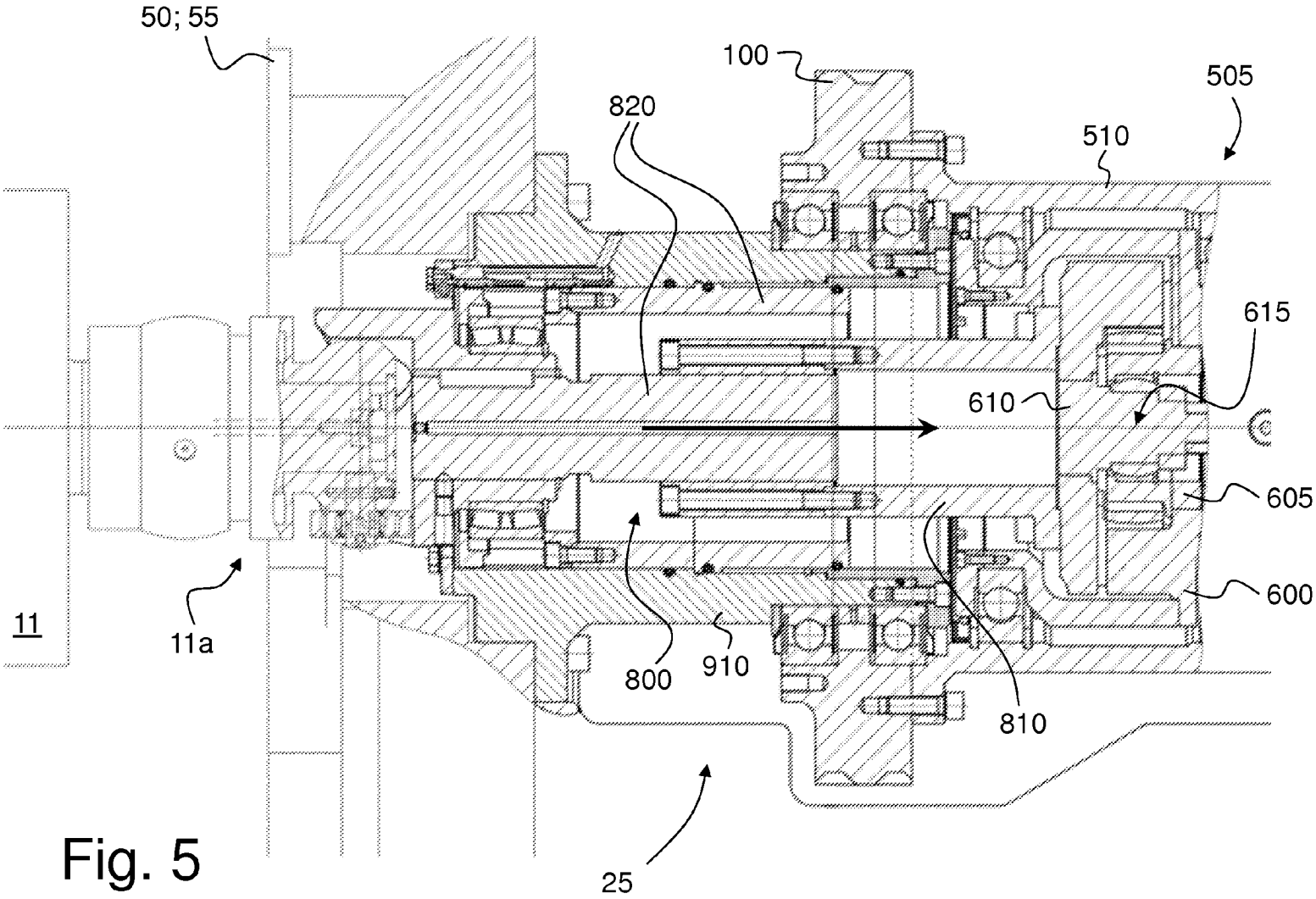
FIG. 5 is an enlarged partial side view of the adjustable drive unit of FIG. 4.

FIG. 5 is an enlarged partial side view of the adjustable drive unit 25 of FIG. 4 illustrating more clearly the retractable coupling mechanism 800 that is interposed between the output member 610 of the planetary gear unit 505 and the driving head part 11*a* of the wiping roller assembly 11. The retractable coupling mechanism 800 basically comprises an input member 810 which is secured to the output member 610 and thus rotates together with the drive output of the planetary gear unit 505 and a slideable output member 820 that is designed to cooperate with the driving head part 11*a* of the wiping roller assembly 11.

The coupling section between the driving head part 11*a* of the wiping roller assembly 11 and the slideable output member 820 is as such known in the art (see for instance European Patent Publication No. EP 0 881 072 A1). A particularity resides in the fact that the slideable output member 820 can be retracted away from the driving head part 11*a* (as schematically indicated by the arrow in FIG. 5) during a maintenance operation. This is in particular meant to allow the wiping roller assembly 11 to be removed from the printing press during cleaning operations or for the purpose of being replaced by a new wiping roller assembly. The slideable movement of the output member 820 can conveniently be carried out by means of a pneumatic or hydraulic actuating system. Members 810 and 820 are shaped in such a way that, in the illustrated example, the output member 820 can slide with respect to the input member 810. Appropriate guidance of the output member 820 is ensured by guiding the output member 820 inside the support member 910.

FIG. 5 further shows that the wiping roller assembly 11 is advantageously coupled to the output of the adjustable drive unit 25 via a spherical bearing (or like bearing), in order to allow for some tolerance regarding the respective orientations of the axis of rotation of the wiping roller assembly 11 and of the axis of rotation of the planetary gear unit 505. Indeed, due to the operation of the wiping roller assembly 11, the axis of rotation thereof does not necessarily coincide with the axis of rotation of the planetary gear unit 505. In the illustrated example, a spherical bearing 615 is thus formed between the output member 610 and components 600, 605 of the planetary gear unit 505 that act as a planet carrier of the planetary gear unit 505. Some tolerance is also ensured at the location where the slideable output member 820 engages with the driving head part 11*a* of the wiping roller assembly 11, i.e. by providing some radial play at the relevant location.

Figure 6:
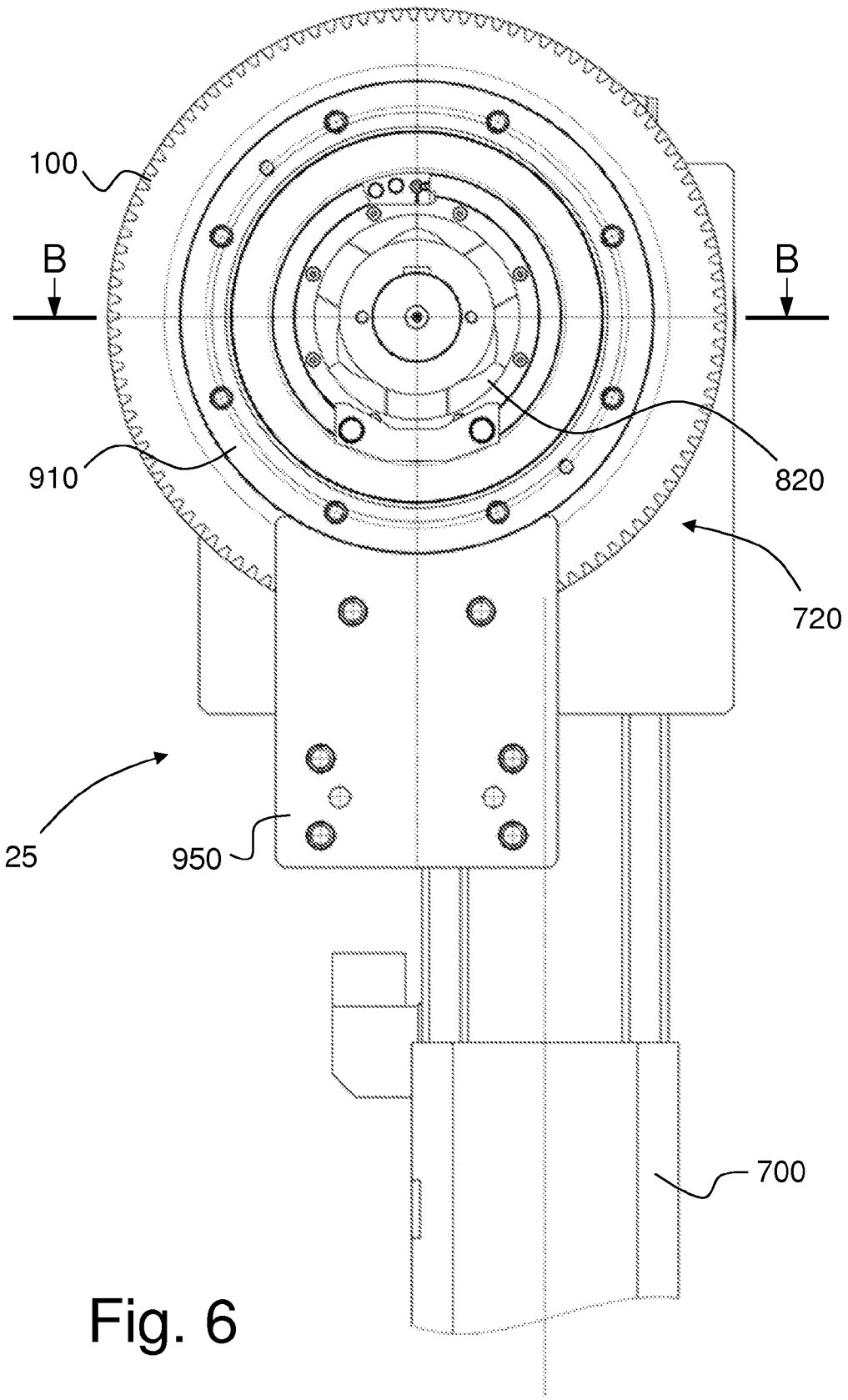
FIG. 6 is a schematic front view of the adjustable drive unit of FIG. 4 as seen from a side intended to be coupled to a driving head part of the wiping roller assembly.
Figure 7:
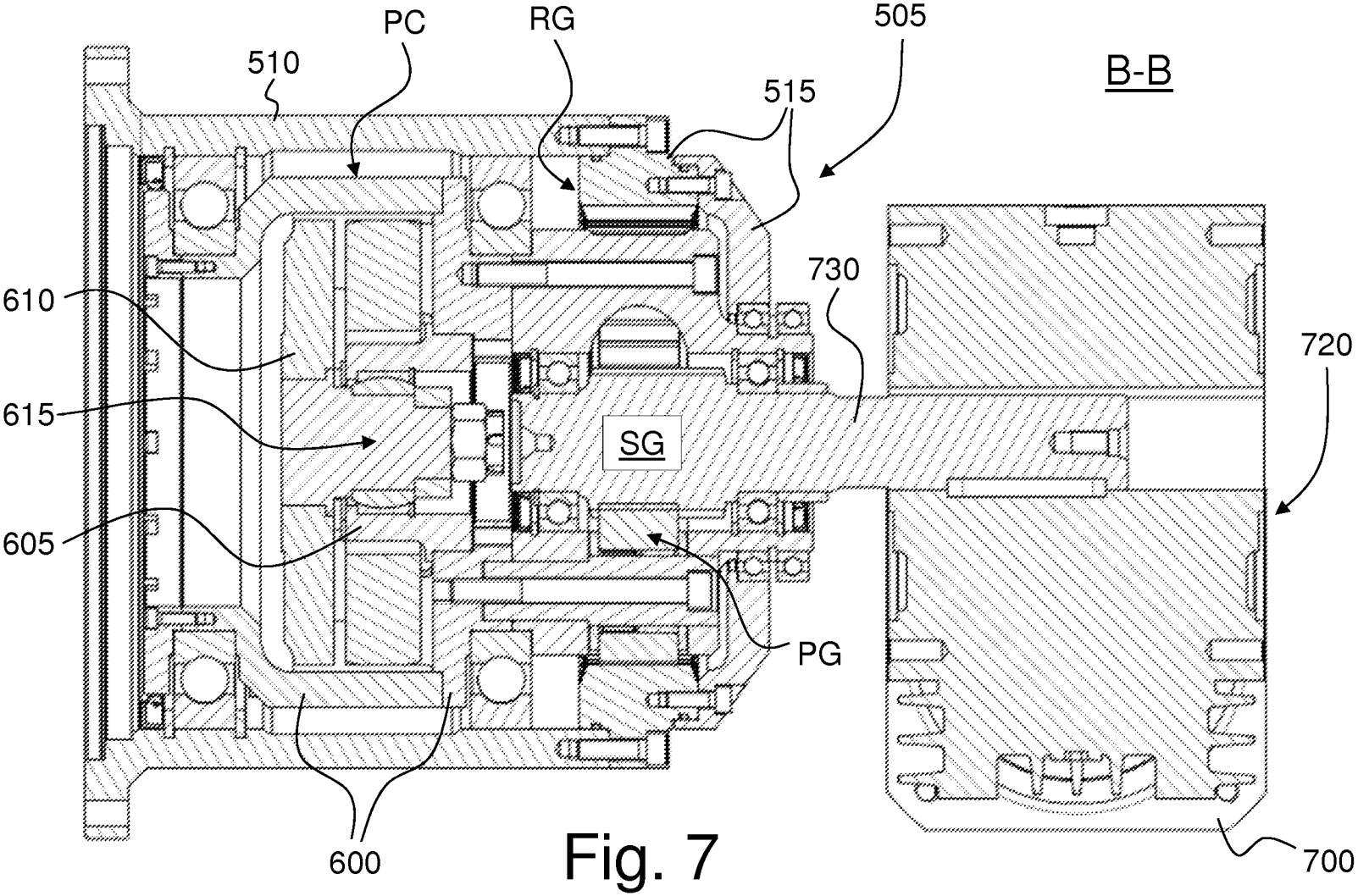
FIG. 7 is a schematic sectional view of an adjustable mechanical transmission unit designed as a planetary gear unit as used in the embodiment of FIGS. 4 to 6, the sectional view being along plane B-B indicated in FIG. 6.

FIG. 6 is a schematic front view of the adjustable drive unit 25 of FIG. 4 as seen from a side intended to be coupled to the driving head part 11*a* of the wiping roller assembly 11. FIG. 7 is a schematic sectional view of the planetary gear unit 505 as taken along plane B-B indicated in FIG. 6 and which more clearly shows the configuration of the planetary gear unit 505.

Visible in FIG. 7 is the outer casing 510 which is secured to the driving gear 100 (not shown in FIG. 7) and to the lateral member 515 of the planetary gear unit 505. In this example, the lateral member 515 is formed of two parts and is designed to act as a ring gear RG (with internal teeth) and drive input of the planetary gear unit 505.

Also shown is the adjustment motor 700 which drives a control shaft 730 penetrating into a central portion of the planetary gear unit 505, which control shaft 730 is coupled to the output of the adjustment motor 700 via a worm drive 720. The extremity of the control shaft 730, inside the planetary gear unit 505 is designed to act as a star gear SG (with external teeth) and control input of the planetary gear unit 505.

Interposed between the ring gear RG and the star gear SG are a plurality of planet gears PG. Three such planet gears PG are provided, which are distributed at intervals of 120° about the star gear SG. The planet gears PG engage on the one hand with the external teeth of the star gear SG and on the other hand with the internal teeth of the ring gear RG.

The planet gears PG are supported onto a planet carrier PC which is mounted so as to rotate about the same axis of rotation as the ring gear RG and star gear SG. The planet carrier PC here acts as the drive output of the planetary gear unit 505. The planet carrier PC consists in this example of an intermediate member 600 that is supported onto a pair of ball bearings inside the outer casing 510. A central member 605 is further secured to a central portion of the intermediate member 600 to act as one part of the spherical bearing 615 that has already been described above. Rotation of the planet carrier PC is transmitted to the output member 610 via a suitable interconnection between the output member 610 and central member 605, while allowing for some angle (if any) between the axis of rotation of the output member 610 and the axis of rotation of the planet carrier PC.

It will be appreciated that the planet gears PG and the planet carrier PC are conveniently located within a housing formed by the outer casing 510 and the lateral member 515, thereby suitably protecting these elements from exposure to the environment.

In the non-adjusting state (i.e. when the adjustment motor 700 in inoperative), the planetary gear unit 505 merely acts as a reducer stage, the wiping roller assembly 11 being driven into rotation exclusively mechanically via the above-described arrangement so as to rotate at a nominal rotational speed dictated by the driving gear 100. In the adjusting state (i.e. when the adjustment motor 700 is operative), the planetary gear unit 505 acts as a differential stage with the wiping roller assembly 11 being driven into rotation at a rotational speed which is a differential function of the rotational speed of the driving gear 100 as transmitted to the ring gear RG and of the rotational speed of the control shaft 730, imposed by the adjustment motor 700 and transmitted to the star gear SG.

Various modifications and/or improvements may be made to the above-described embodiments without departing from the scope of the invention as defined by the annexed claims.

In particular, while the illustrations of FIGS. 1 to 3 show intaglio printing presses equipped with conventional inking devices, any other suitable inking device could be used for the purpose of inking the chablon cylinders. In that respect, the inking devices could for instance be inking devices as disclosed in International Publication No. WO 2005/077656 A1 (which is also incorporated herein by reference in its entirety).

LIST OF REFERENCE NUMERALS USED THEREIN

1 (sheet-fed) intaglio printing press (first embodiment)
1* (sheet-fed) intaglio printing press (second embodiment)
2 sheet feeder
3 intaglio printing unit (first embodiment)
3* intaglio printing unit (second embodiment)
4 sheet delivery (with three delivery pile units)
5 optical inspection system (e.g. NotaSave®)
6 drying or curing unit
7 impression cylinder (three-segment cylinder)
8 intaglio cylinder (three-segment plate cylinder carrying three intaglio printing plates)
9 ink collecting cylinder/Orlof cylinder (three-segment blanket cylinder—first embodiment)
10 ink wiping system
11 rotating wiping roller assembly of ink wiping system 10 (contacts circumference of intaglio cylinder 8)
11*a* driving head part of rotating wiping roller assembly 11
15 sheet transporting system (sheet conveyor system with a pair of endless chains driving a plurality of spaced-apart gripper bars for holding a leading edge of the sheets)
20 (five) inking devices (first embodiment)
21 ink duct (first embodiment)
22 ink-application rollers (first embodiment)
23 (five) chablon cylinders/selective inking cylinders transferring ink onto ink-collecting cylinder 9 (first embodiment)
20* (five) inking devices (second embodiment)
21* ink duct (second embodiment)
22* ink-application rollers (second embodiment)
23* (five) chablon cylinders/selective inking cylinders transferring ink onto plate cylinder 8 (second embodiment)
24* ink transfer rollers (second embodiment)
25 adjustable drive unit of wiping roller assembly 11
50 stationary machine frame supporting impression cylinder 7, plate cylinder 8 and ink wiping system 10 (first embodiment)
51 intermediate carriage supporting ink-collecting cylinder 9 and chablon cylinders 23 (first embodiment)
52 inking carriage supporting inking devices 20 (first embodiment)
52' inking carriage 52 in the retracted position (first embodiment)
55 stationary machine frame supporting impression cylinder 7, plate cylinder 8, chablon cylinders 23* and ink wiping system 10 (second embodiment)
56 inking carriage supporting inking devices 20* (second embodiment)
100 driving gear of wiping roller assembly 11/input drive gear of adjustable drive unit 25
505 adjustable mechanical transmission unit/planetary gear unit
510 outer casing of planetary gear unit 505 (secured to driving gear 100)
515 lateral member of planetary gear unit 505 (secured to outer casing 510 and acting as ring gear RG of planetary gear unit 505)
600 intermediate member acting as planet carrier PC of planetary gear unit 505 (supported for rotation inside outer casing 510)
605 central member secured to intermediate member 600
610 output member of adjustable drive unit 25 (acting as drive output of adjustable drive unit 25)
615 spherical bearing between central member 605 and output member 610
700 adjustment motor (e.g. servo motor) of adjustable drive unit 25
720 worm drive interposed between output shaft of adjustment motor 700 and control input of planetary gear unit 505
730 control shaft coupled to drive output of worm drive 720 (acts as star gear SG of planetary gear unit 505)
800 retractable coupling mechanism
810 input member of retractable coupling mechanism 800 (secured to output member 610)
820 slideable output member of retractable coupling mechanism 800 (coupled to driving head part 11*a* of wiping roller assembly 11)
910 support member supporting adjustable drive unit 25 (secured to stationary machine frame 50 or 55)
950 support member supporting adjustment motor 700 (secured to stationary machine frame 50 or 55)
RG ring (annular) gear of planetary gear unit 505/acts as drive input of planetary gear unit 505
PG planet gears (or "planets") of planetary gear unit 505
PC planet carrier of planetary gear unit 505/acts as drive output of planetary gear unit 505
SG star (central) gear of planetary gear unit 505/acts as control input of planetary gear unit 505

The invention claimed is:

1. An intaglio printing press comprising an intaglio cylinder and an ink wiping system with a rotating wiping roller assembly contacting a circumference of the intaglio cylinder for wiping excess ink from the surface of the intaglio cylinder, a rotational speed of the wiping roller assembly being adjustable with respect to a rotational speed of the intaglio cylinder, wherein the intaglio printing press comprises an adjustable drive unit, which adjustable drive unit is interposed between the wiping roller assembly acting as a rotating output body of the adjustable drive unit and a driving gear coupled to the intaglio cylinder and acting as a rotating input body of the adjustable drive unit, wherein the adjustable drive unit is designed to allow selected adjustment of a rotational speed of the wiping roller assembly with respect to a rotational speed of the driving gear, wherein, in an adjusting state of the adjustable drive unit, driving into rotation of the wiping roller assembly is adjusted by means of an adjustment motor of the adjustable drive unit to change the rotational speed of the wiping roller assembly with respect to the rotational speed of the intaglio cylinder, and wherein, in a non-adjusting state of the adjustable drive unit, the adjustment motor is inoperative and driving into rotation of the wiping roller assembly is performed exclusively mechanically via the adjustable drive unit, the wiping roller assembly rotating at a defined rotational speed with respect to the rotational speed of the intaglio cylinder.

2. The intaglio printing press as defined in claim 1, wherein the rotational speed of the wiping roller assembly is adjustable, in the adjusting state of the adjustable drive unit, within a range of +20% and −20% with respect to a nominal rotational speed of the wiping roller assembly in the non-adjusting state of the adjustable drive unit.

3. The intaglio printing press as defined in claim 1, further comprising a retractable coupling mechanism coupled between a drive output of the adjustable drive unit and a driving head part of the wiping roller assembly, which retractable coupling mechanism is operable to release the driving head part of the wiping roller assembly during a maintenance operation.

4. The intaglio printing press as defined in claim 3, wherein the retractable coupling mechanism comprises an input member coupled to the drive output of the adjustable drive unit and an output member designed to cooperate with the driving head part of the wiping roller assembly, the output member being retractable away from the driving head part during a maintenance operation by sliding the output member with respect to the input member.

5. The intaglio printing press as defined in claim 1, wherein the wiping roller assembly is coupled to an output of the adjustable drive unit via a spherical bearing.

6. The intaglio printing press as defined in claim 1, wherein the adjustable drive unit comprises an adjustable mechanical transmission unit having a drive input coupled to and rotating together with the driving gear, a drive output coupled to and rotating together with the wiping roller assembly, and a control input coupled to and driven into rotation by the adjustment motor.

7. The intaglio printing press as defined in claim 6, wherein the adjustable mechanical transmission unit is designed as a planetary gear unit comprising a ring gear acting as the drive input of the planetary gear unit, a star gear disposed centrally with respect to the ring gear and acting as the control input of the planetary gear unit, and a plurality of planet gears interposed between and meshing with the ring gear and the star gear, which plurality of planet gears are carried by a planet carrier coaxial with the ring gear and star gear and acting as the drive output of the planetary gear unit.

8. The intaglio printing press as defined in claim 7, wherein the adjustable mechanical transmission unit comprises a housing and wherein the plurality of planet gears and the planet carrier are located within the housing.

9. The intaglio printing press as defined in claim 8, wherein the housing comprises an outer casing and a lateral member which are secured to one another and to the driving gear, the lateral member acting as the ring gear.

10. The intaglio printing press as defined in claim 6, wherein the adjustment motor is coupled to the control input of the adjustable mechanical transmission unit by way of a worm drive.

11. The intaglio printing press as defined in claim 1, wherein the adjustment motor is supported on a same machine frame as the wiping roller assembly.

12. The intaglio printing press as defined in claim 6, wherein the adjustment motor is supported on and secured to a same machine frame as the wiping roller assembly by means of a first support member, and wherein one end of the adjustable mechanical transmission unit is supported and secured on the same machine frame as the wiping roller assembly by means of a second support member, another end of the adjustable mechanical transmission unit being held by the first support member.

13. Adjustment system designed to allow adjustment of a rotational speed of a wiping roller assembly of an intaglio printing press, which adjustment system comprises an adjustable drive unit, which adjustable drive unit is interposed between the wiping roller assembly acting as a rotating output body of the adjustable drive unit and a driving gear coupled to an intaglio cylinder of the intaglio printing press and acting as a rotating input body of the adjustable drive unit, wherein the adjustable drive unit is designed to allow selected adjustment of a rotational speed of the wiping roller assembly with respect to a rotational speed of the driving gear, wherein, in an adjusting state of the adjustable drive unit, driving into rotation of the wiping roller assembly is adjusted by means of an adjustment motor of the adjustable drive unit to change the rotational speed of the wiping roller assembly with respect to the rotational speed of the intaglio cylinder, and wherein, in a non-adjusting state of the adjustable drive unit, the adjustment motor is inoperative and driving into rotation of the wiping roller assembly is performed exclusively mechanically via the adjustable drive unit, the wiping roller assembly rotating at a defined rotational speed with respect to the rotational speed of the intaglio cylinder.

14. The adjustment system as defined in claim 13, wherein the rotational speed of the wiping roller assembly is adjustable, in the adjusting state of the adjustable drive unit, within a range of +20% and −20% with respect to a nominal rotational speed of the wiping roller assembly in the non-adjusting state of the adjustable drive unit.

15. The adjustment system as defined in claim 13, wherein the adjustable drive unit comprises an adjustable mechanical transmission unit having a drive input coupled to and rotating together with the driving gear, a drive output coupled to and rotating together with the wiping roller assembly, and a control input coupled to and driven into rotation by the adjustment motor.

16. The adjustment system as defined in claim 15, wherein the adjustable mechanical transmission unit is designed as a planetary gear unit comprising a ring gear acting as the drive input of the planetary gear unit, a star gear disposed centrally with respect to the ring gear and acting as the control input of the planetary gear unit, and a plurality of planet gears interposed between and meshing with the ring gear and the star gear, which plurality of planet gears are carried by a planet carrier coaxial with the ring gear and star gear and acting as the drive output of the planetary gear unit.

17. The adjustment system as defined in claim 16, wherein the adjustable mechanical transmission unit comprises a housing and wherein the plurality of planet gears and the planet carrier are located within the housing.

18. The adjustment system as defined in claim 17, wherein the housing comprises an outer casing and a lateral member which are secured to one another and to the driving gear, the lateral member acting as the ring gear.

19. The adjustment system as defined in claim 15, wherein the adjustment motor is coupled to the control input of the adjustable mechanical transmission unit by way of a worm drive.

* * * * *